United States Patent [19]

Wirth

[11] Patent Number: 4,662,517

[45] Date of Patent: May 5, 1987

[54] RAPPEL ROPE DEPLOYMENT BAG

[76] Inventor: Craig L. Wirth, P.O. Box 6105, Spokane, Wash. 99207-0902

[21] Appl. No.: 792,322

[22] Filed: Oct. 28, 1985

[51] Int. Cl.[4] ..... B65D 85/16

[52] U.S. Cl. ..... 206/388; 150/52 R; 206/479; 383/38

[58] Field of Search ..... 150/52 R, 52 J, 52 K; 182/196, 197, 198, 199; 206/388, 477, 478, 479, 481, 483, 49; 383/38, 39

[56] References Cited

U.S. PATENT DOCUMENTS

| | | | |
|---|---|---|---|
| 1,705,050 | 3/1929 | Taylor | 206/388 |
| 2,994,356 | 8/1961 | Fleming | 150/52 K |
| 3,749,233 | 7/1973 | McCormick, Jr. | 383/39 |

FOREIGN PATENT DOCUMENTS

| | | | |
|---|---|---|---|
| 81/02558 | 9/1981 | PCT Int'l Appl. | 150/52 R |
| 0012836 | of 1903 | United Kingdom | 206/388 |
| 0414694 | 8/1934 | United Kingdom | 206/388 |
| 0449597 | 6/1936 | United Kingdom | 206/388 |

*Primary Examiner*—William Price
*Assistant Examiner*—Jimmy G. Foster
*Attorney, Agent, or Firm*—Harvey B. Jacobson

[57] ABSTRACT

An elongated flexible panel is provided and defines anchor loops spaced along its opposite side longitudinal marginal edges from which the looped ends of one or more serpentine folded rappel rope sections may be releaseably supported. The panel is rollable into a compact state and includes end straps at one end thereof which may be encircled and releaseably secured about the panel when in a rolled state. One end of the panel is weighted and when the rope portions at the other end of the panel are attached to a suitable elevated anchor point the rolled panel may be thrown out and will unroll to a vertical position with the weighted end thereof lowermost as the panel drops to a lower level and the rappel rope section or sections are deployed from the panel.

9 Claims, 8 Drawing Figures

RAPPEL ROPE DEPLOYMENT BAG

BACKGROUND OF THE INVENTION

1. Field of the Invention

This invention relates to a flexible panel from which serpentine-folded rope sections may be supported for ease in deployment therefrom and with the panel being rollable into and releaseably securable in a compact rolled state for storage and/or shipment.

2. Description of Related Art

Various different forms of devices heretofore have been provided for compact storage and deployment of elongated flexible members. In addition, elongated flexible storage members have been provided for storing a plurality of longitudinally spaced and transversely extending elongated members therefrom with the storage members being rollable into a compact rollable state. Examples of these different forms of devices are disclosed in U.S. Pat. Nos. 478,452, 632,226, 3,575,327, 3,676,882 and 3,942,636. However, these previously known devices are not specifically designed to provide a convenient and inexpensive apparatus for storing, transporting and deploying a pair of rappel rope sections.

SUMMARY OF THE INVENTION

The rappel rope deployment bag of the instant invention includes an elongated flexible panel constructed of untreated canvas and including opposite side longitudinal side margins and opposite end transverse end margins. A plurality of support loops are supported from one side of the panel and spaced along each of the side margins thereof for supporting at least one rappel rope section therefrom with the rope section folded in serpentine fashion and the folded loops thereof releasably received in the support loops of the panel. The panel includes a first weighted end margin and the other or second end margin of the panel includes a pair of elongated straps anchored thereto and extending outwardly therefrom whereby the straps may be secured about the panel when the latter is rolled from the first mentioned end margin thereof toward the last mentioned end margin.

The main object of this invention is to provide a means whereby rappel rope sections may be conveniently and efficiently downwardly deployed from an elevated anchor point.

Another object of this invention, in accordance with the immediately preceding object, is to provide a structure in accordance with the preceding objects which may also be used to store and transport rappelling rope sections in readiness for their deployment.

Still another important object of this invention is to provide a rappel rope section deployment apparatus so designed and constructed to eliminate substantially all possibility of the rappel rope section becoming entangled during deployment.

A further object of this invention is to provide a rappel rope deployment apparatus which may be used for deploying rappel rope sections from a helicopter in a manner to prevent the deployed rope sections from blowing back up into the rotor blades of a helicopter from which the rope sections are deployed.

A final object of this invention to be specifically enumerated herein is to provide a rappel rope deployment apparatus in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompany drawings forming a part hereof, wherein like numerals refer to like parts throughout.

DESCRIPTION OF THE PREFERRED EMBODIMENT

Figure 1:
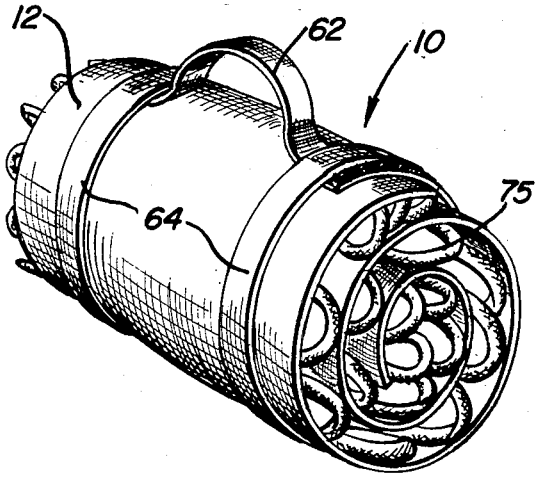
FIG. 1 is a perspective view of the rappel rope deployment apparatus of the instant invention in a rolled condition for storage and/or ready transports.
Figure 2:
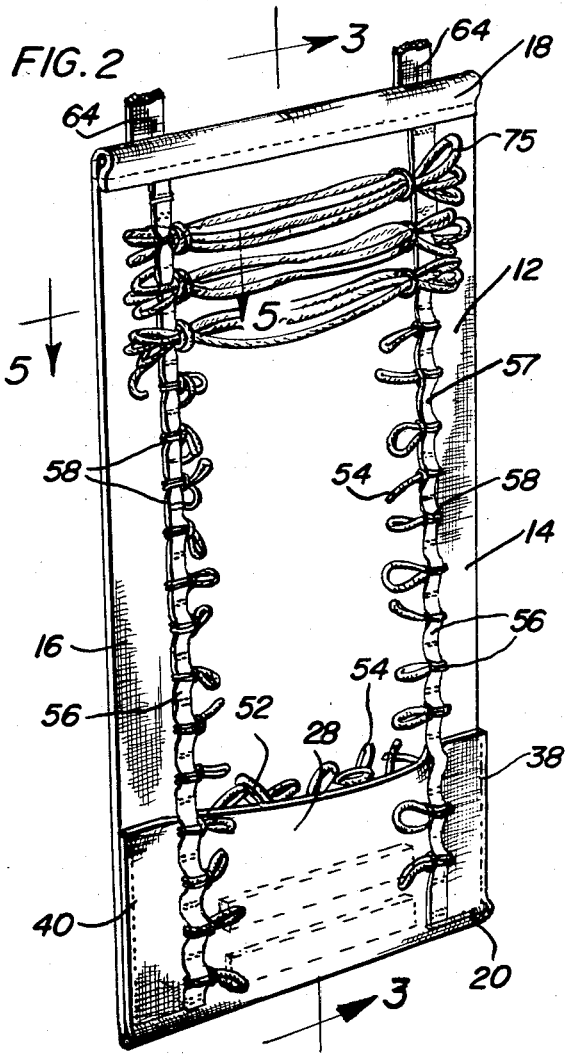
FIG. 2 is a fragmentary perspective view of the rappel rope deployment apparatus in an open position and illustrating the manner in which rappel rope sections may be supported therefrom, portions of the retaining straps of the deployment apparatus being broken away.

Referring now more specifically to the drawings the numeral 10 generally designates the rappel rope deployment bag of the instant invention. The bag 10 includes an elongated flexible panel 12 constructed of non-treated canvas and including opposite side longitudinal side margins 14 and 16 and opposite end transverse end margins 18 and 20.

The end margin 18 includes a reversely turned end terminal portion 22 overlying the innerside 24 of the panel 12 and secured thereto as at 26 in order to form an end transverse hem. The end margin 20 includes a similar reversely turned terminal portion 28 of the panel 12 which also overlies the innerside 24 and is secured thereto as at 30, 32, 34 and 36. In addition, the terminal portion 28 is secured along the side margins 14 and 16 as at 38 and 40.

Transverse pockets 42 and 44 are defined by the terminal portion 28 and the securement thereof to the panel 12 as at 30, 32, and 34, 36 and elongated weight bars 46 and 48 are disposed within the pockets 42 and 44. In addition, the end margin 20 has an elongated cushion member 50 such as a length of small diameter rope secured therein. Also, the end of the terminal portion 28 remote from the cushion member 50 is secured only to the side margins 14 and 16 as at 38 and 40 and defines a pocket 52 for receiving a plurality of rubber bands 54 therein.

Figure 6:
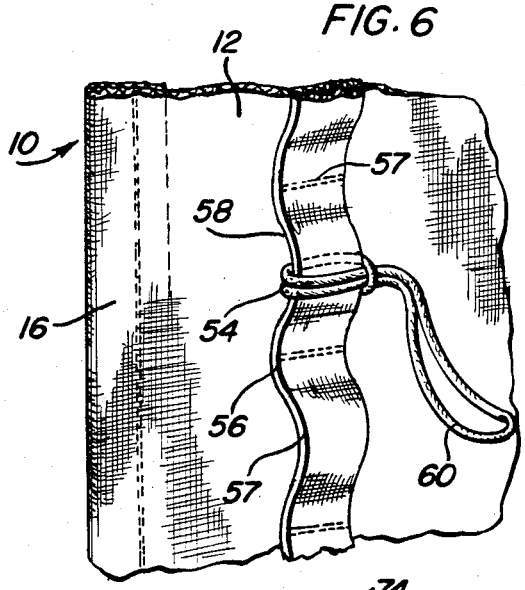
FIG. 6 is a fragmentary enlarged perspective view of one side marginal portion of the panel of the apparatus illustrating the manner in which the rope loop retaining rubber bands of the apparatus are anchored to the outer portion thereof.
Figure 8:
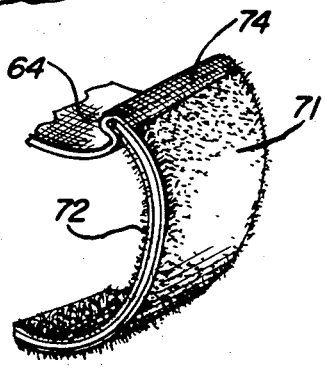
FIG. 8 is a fragmentary enlarged perspective view of one end portion of one of the straps of the apparatus.

Each of the side margins 14 and 16 includes an elongated flexible strip member 56 secured thereto at points spaced longitudinally therealong as at 57 and the strip members 56 define attaching loops 58 spaced along the side margins 14 and 16. A rubber band 54 is anchored to each attaching loop 58 in a manner best seen from FIG. 6 of the drawings and each rubber band 54 defines a resilient, flexible and stretchable anchor loop 60 for a purpose to be hereinafter more fully set forth.

The end margin 18 has an elongated strap-type canvas handle 62 secured thereto at opposite ends of the handle and a pair of elongated canvas straps 64 have one pair of ends secured to corresponding ends of the handle 62 and the underlying portions of the panel 12 in any convenient manner such as by stitching. Further, the outer sides of the ends of the straps anchored to the handle end 62 include loop-type VELCRO fastening strips 66 secured thereto. In addition, similar looptype strips 68 are secured to the strap 64 closely adjacent the strips 66 and the outer side of each strap 64, at the end thereof remote from the strips 66 has an elongated loop-type attaching strip 70 secured thereto, the strips 70 being of considerably greater length than the strips 66 and 68. The inner sides of the free ends of the strips 64 include similar hook-type VELCRO fastening strips 72 secured thereto and free ends of the straps 64 are folded and sewn as at 74 for purpose to be hereinafter more fully set forth. Still further, the panel 12 includes an additional pair of loop-type VELCRO strips 70 secured thereto immediately adjacent and in alignment with strips 66.

Figure 3:
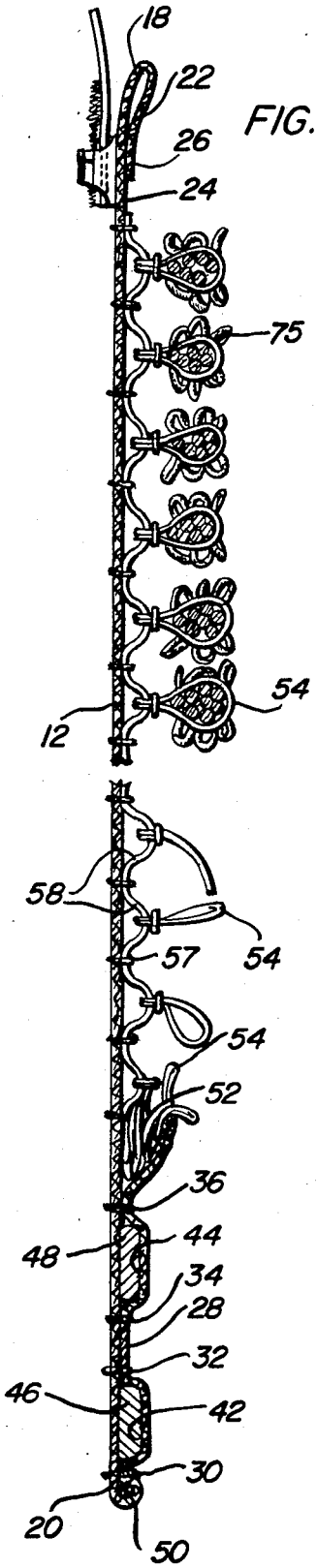
FIG. 3 is an enlarged vertical sectional view taken substantially upon the plane indicated by the section line 3—3 of FIG. 2.
Figure 4:
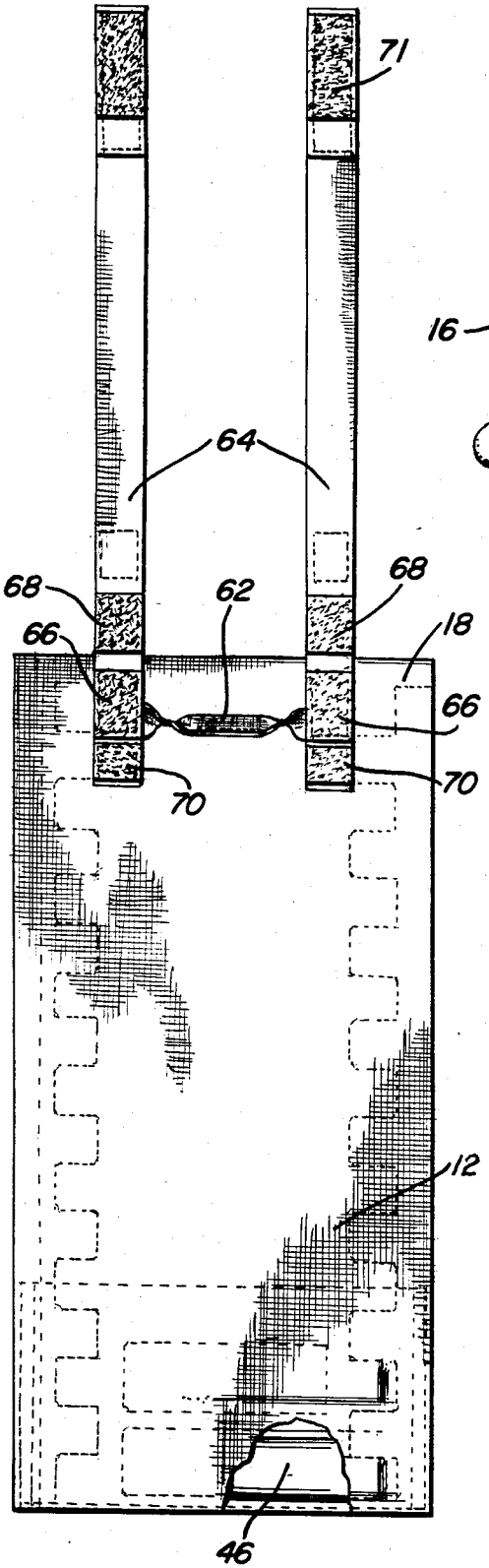
FIG. 4 is a plan view of the rappel rope section deployment apparatus in a fully extended position.
Figure 7:
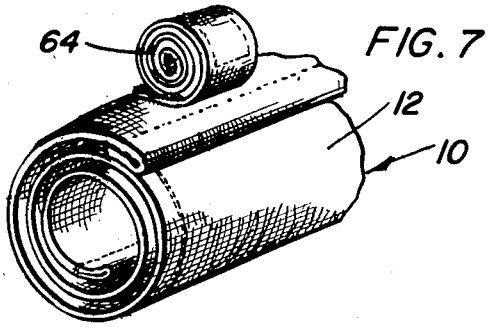
FIG. 7 is a fragmentary perspective view of the apparatus in a rolled condition and with one of the straps in a rolled non-use stored position.
Figure 5:
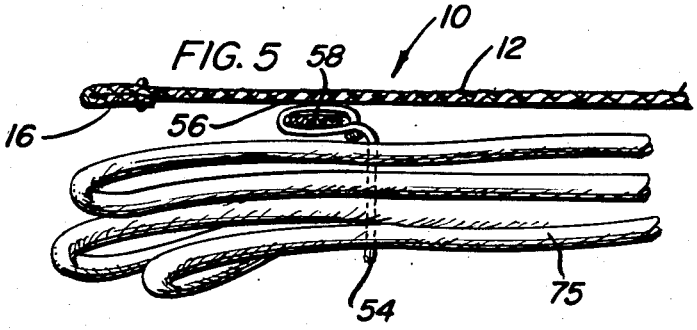
FIG. 5 is an enlarged fragmentary horizontal sectional view taken substantially upon the plane indicated by the section line 5—5 of FIG. 2.

In operation, either a single, doubled, 120 foot length of rappel rope sections 75 or a pair of 120 foot rappel rope sections 75 are folded in serpentine fashion with the loops thereof received through the loops 60. In this manner, a single 120 foot length rappel rope or two 120 foot length rappel ropes may be supported from the loops 60. The panel 12 is then rolled from the end margin 20 toward the end margin 18 and the straps 64 are passed about the rolled panel 12 and either the strips 70 or the strips 71 may be releasably anchored to the strips 66 and/or 68, see FIG. 1. In this manner, the deployment bag may be retained in a compact state for transport and/or storage. When it is desired to deploy the rope section or sections 75, the straps 64 are detached and the free ends thereof are rolled up and secured to the corresponding strips 66 and/or 70, see FIG. 7. Then, either the folded end of the single rappel rope section or the ends of the two rappel rope sections adjacent the handle end of the panel 12 are suitably anchored from an elevated support structure (such as a frame specifically provided for this purpose in a helicopter) and the bag is thrown out. The weight bars 46 will cause the bag to unroll and the rope section or sections will be pulled from the loops 60 as the panel 12 descends through the air. The lighter upper end of the panel acts as a tail fin to maintain the panel 12 in a vertical position such as that illustrated in FIG. 3 as the rope sections or ropes 75 are being pulled from the loop 60. The member 50 cushions that portion of the panel 12 enclosing the lower weight bar 46 against impact and the pocket 52 is of course utilized to retain a supply of additional rubber bands 54 therein.

If a single (doubled) rappel rope section 75 is used, when the straps 64 are disposed about the bag as illustrated in FIG. 1, the strips 70 are used to secure the strap ends to the strips 66 and/or 68. However, when two 120 foot rappel rope sections 75 are used in the bag 10, the ends of the straps 64 are unfolded and the strips 71 are anchored relative to the corresponding strips 66 and 68, the unfolding of the ends of the straps 64 rendering the effective lengths of the straps greater in order to encircle the bag 10 supporting a pair of 120 foot rappel rope sections 75 as opposed to a single, doubled, 120 foot rappel rope section.

The canvas panel 12 is of the non-treated type whereby the rappel rope section or sections 75 will not be adversely affected by the treatment materials used in treating canvas to render it waterproof.

The handle 62 is used not only to support the rolled straps 64 during deployment of the bag 10, but also constructed in a manner to prevent any possible entaglement of the bag or rope section 75 with the handle 62.

Of course, the panel 12 may be recovered once the rope section or sections 75 have been deployed and utilized for repelling purposes merely by tying the lower end of rope section or sections to the handle. Also, by weighting the panel 12 not only is entangelment of the rope section or sections 75 avoided, but there is no possibility that the rope section or sections being deployed from a helicopter will blow back up into the helicopter rotors.

It is believed apparent that the bag 10 comprises a convenient, efficient, and inexpensive means of storing and deploying rappel rope sections. Before development of the bag 10, common methods of deploying rope even by the military included first tying the rope in a daisychain and throwing the rope out of a helicopter or the wrapping of the rope around the log and then throwing the log out of the helicopter. Obviously, these crude methods of rappel rope deployment often met with failure.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A rappel rope deployment bag including an elongated flexible panel including opposite side longitudial side margins and opposite and transverse end margins, a plurality of support loops supported from one side of said panel and spaced along each of said side margins for supporting at least one rappel rope section therefrom with said rope section folded in serpentine fashion and the loops thereof received in said support loops, one of said margins of said panel including means for providing additional weight, there at said panel, with a folded rope section supported from said support loops, being rollable into a compact state and including retaining means for releaseably retaining said panel in the said rolled compact state, said retaining means including a pair of strap members each having a first end anchored on a side opposite said one side and at the end margin opposite said one end margin, said strap members being of a length to extend fully about said panel in one direction when said panel is rolled into said compact state, said first ends and the second ends of said strap members including first and second co-acting thistle-type attaching means, respectively, supported therefrom releaseably retaining said strap members secured about said rolled panel, said second ends including reverseably foldable terminal ends, said second attaching means including attaching means on both sides of said terminal ends selectively releaseably engageable with said first co-acting attaching means carried by said first ends of said strap members, whereby the effective length of said strap members may be varied according to the diameter of said rolled panel determined by the number of folded rope sections supported from said support loops.

2. A rappel rope deployment bag including an elongated flexible panel including opposite side longitudinal side margins and opposite and transverse end margins, a plurality of support loops supported from one side of said panel and spaced along each of said side margins for supporting at least one rappel rope section therefrom with said rope section folded in serpentine fashion and the loops thereof received in said support loops, one of said end margins of said panel including means for providing additional weight thereat said panel, with a folded rope section supported from said support loops, being rollable into a compact state and including retaining means for releaseably retaining said panel in the said rolled compact state, said retaining means including a pair of strap members each having a first end anchored on a side opposite said one side and at the end margin opposite said one end margin, said strap members being of a length to extend fully about said panel in one direction when said panel is rolled into said compact state, said first ends and the second ends of said strap members including first and second co-acting thistle-type attaching means, respectively, supported therefrom releaseably retaining said strap members secured about said rolled panel, said strap members being rollable upon themselves in the opposite direction and said first and second co-acting attaching means carried by said strap members being engageable with each other to retain said strap members, when rolled in said opposite direction, in a rolled condition in spaced apart relation on said other end of margin of said panel.

3. A rappel rope deployment bag including an elongated flexible panel including opposite side longitudinal side margins and opposite and transverse end margins, a plurality of support loops supported from one side of said panel and spaced along each of said side margins for supporting at least one rappel rope section therefrom with said rope section folded in serpentine fashion and the loops thereof received in said support loops, one of said margins end of said panel including means for providing additional weight thereat, said panel, with a folded rope section supported from said support loops, being rollable into a compact state and including retaining means for releasably retaining said panel in the said rolled compact state, said side margins including flexible strip members extending therealong and joined to said panel at points spaced longitudinally therealong, said strip members, between points of securement with said panel, defining anchor loops, said anchor loops including rubber bands slip-looped thereabout to define said support loops.

4. The rappel rope deployment bag of claim 3 wherein said retaining means icludes a pair of strap members each having a first end anchored relative to opposite ends of said other end margin, said strap members being of a length to extend fully about said panel in one direction when said panel is rolled into said compact state, said first ends and the second ends of said strap members including first and second co-acting thistle-type attaching means, respectively, supported therefrom releaseably retaining said strap members secured about said rolled panel.

5. The rappel rope deployment bag of claim 3 wherein said panel is constructed of canvas.

6. The rappel rope deployment bag of claim 5 wherein said canvas panel is "untreated".

7. A rappel rope deployment bag including an elongated flexible panel including opposite side longitudinal side margins and opposite and transverse end margins, a plurality of support loops supported from one side of said panel and spaced along each of said side margins for supporting at least one rappel rope section therefrom with said rope section folded in serpentine fashion and the loops thereof received in said support loops, one end of margin of said panel including means for providing weight, said panel, with a folded rope section supported from said support loops, being rollable into a compact state and including retaining means for releaseably retaining said panel in the said rolled compact state, said means for providing weight including a weight bar extending along and non-removably supported from said one end margin of said panel with said weight bar extending along a major portion of the length of said one end margin.

8. The rope deployment bag of claim 7 wherein said one end margin of said panel includes an end edge seam having an elongated impact cushioning member secured therein and extending therealong said weight bar being disposed within a tubular pocket defined by said panel member extending along said one end margin thereof inwardly of said end edge seam.

9. The rope deployment bag of claim 7 wherein said means for providing weight includes a second weight bar spaced laterally form the first mentioned weight bar and supported from said panel, said second weight bar being spaced along panel from the first mentioned weight bar towards the end marginal said panel opposite said one end margin.

* * * * *